United States Patent [19]

Resnick

[11] 4,424,911

[45] Jan. 10, 1984

[54] CONTAINER TAMPER DETECTION DEVICE

[75] Inventor: Joseph A. Resnick, Natrona Heights, Pa.

[73] Assignee: Kenneth R. Bowers, Bryn Mawr, Pa.

[21] Appl. No.: 434,838

[22] Filed: Dec. 10, 1982

[51] Int. Cl.[3] ..... B65D 55/02

[52] U.S. Cl. ..... 215/365; 215/230; 215/250; 116/203; 116/206; 206/459; 206/807; 428/321.5; 428/916

[58] Field of Search ..... 116/203, 206, 212, 200; 73/762; 428/915, 916; 215/365, 230, 250; 220/214; 206/807, 459; 436/1

[56] References Cited

U.S. PATENT DOCUMENTS

| | | | |
|---|---|---|---|
| 3,515,091 | 6/1970 | Smith | 116/203 |
| 3,786,777 | 1/1974 | Smith et al. | 116/206 |
| 3,803,485 | 4/1974 | Crites et al. | 73/762 X |
| 4,197,346 | 4/1980 | Stevens | 428/914 X |

*Primary Examiner*—Donald F. Norton
*Attorney, Agent, or Firm*—Kenneth R. Bowers

[57] ABSTRACT

A tampering indicator for medicine bottles which changes color upon pressure applied to the bottle during opening.

10 Claims, 1 Drawing Figure

CONTAINER TAMPER DETECTION DEVICE

BACKGROUND

This invention relates to a device for signaling that a container has been opened.

Many food and drug substances are distributed within bottle containers. Because these substances are destined for human consumption, there is desired that the container never be opened prior to use by the ultimate owner and user of the bottle. Unfortunately, present bottles can be opened, and foreign or even poison substances added, without a clear indication later that the bottle has been opened.

Consequently it is desired to provide a device which will signal that a container has been opened.

SUMMARY

A strip of litmus paper of double thickness contains pressure sensitive acid bearing microspheres between layers of the strip. The strip is located on a portion of the container where pressure must be applied for entry, which pressure breaks the microspheres, releasing mild acid into the paper resulting in a permanent color change in the strip.

DETAILED DESCRIPTION

Figure 1:
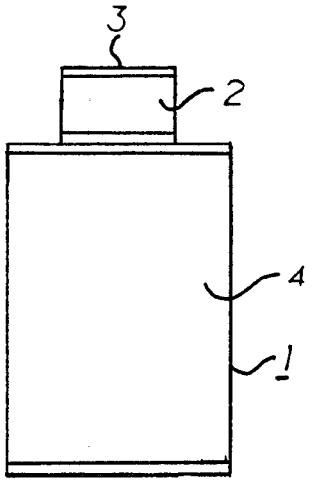
FIG. 1 is a profile schematic of an embodiment of the invention.

Many containers are designed to require application of pressure to a surface to enable entry. For example, many drug containers are intended to be "child proof" by virtue of the need for a radial pressure on the cap simultaneously with rotational torque, to remove the container lid.

The current invention is a paper to be pasted over such surfaces where pressure must be exerted to remove the lid or even to securely hold the container, which will change color permanently when such pressure is applied.

The paper may be of double thickness. Entrapped between layers of the paper or within the paper are multitudes of microspheres containing a substance. Pressure on the paper ruptures the microsphere, releasing the substance into the paper.

Complete absorption of the substance by the paper, and retention of the microsphere debris within the layered paper, are envisioned features.

The nature of the paper and released substance are chosen to produce a permanent color change. For example, ordinary porous paper may be used with an ink or dye. Litmus paper may be used with a basic or acidic substance.

The substance may be in liquid or gaseous form.

The substance may be ascorbic acid, which is considered to be a mild, harmless acid.

The spheres may be of glass or plastic or other material and may be similar to the spheres available from KMS Industries of Ann Arbor, Mich.

FIG. 1 illustrates a bottle of pills, having a strip 2 of paper containing spheres (not shown) which are filled with a color change initiating substance. Strip 2 is located on a surface where pressure must be exerted to remove lid 3 from bottle 1.

Bottle 1 also has a label 4 of paper which may contain a color change initiating substance. It may be desired for the functions of label 4 and strip 2 to differ. For example, strip 2 may be an ink and porous paper combination while label 4 may be an acid-litmus paper combination. This information need not be revealed on the label, or consistant with all bottles. The label 4 need only warn against consumption of the bottle contents if a color change is seen on label 4 or strip 2, prior to possession by the user.

I claim:

1. A container having:

(a) at least one strip of pliable material affixed to an outside surface of said container;

(b) a plurality of fragile microspheres attached to said strip;

(c) a substance contained within said microspheres which when released from said microspheres caused by destruction of said microspheres by pressure on said strip and upon interaction with said strip, initiates a color change within said strip.

2. The invention of claim 1 wherein said pliable material is paper.

3. The invention of claim 1 wherein said pliable material is litmus paper and said substance is an acid.

4. The invention of claim 1 wherein said pliable material is litmus paper and said substance is a base.

5. The invention of claim 1 wherein said substance is an ink.

6. The invention of claim 1 wherein said substance is a dye.

7. The invention of claim 1 wherein said microspheres are glass.

8. The invention of claim 1 wherein said strip is of sufficient thickness to substantially absorb all of said substance upon destruction of said microspheres.

9. The invention of claim 1 wherein said substance is a gas.

10. The invention of claim 1 wherein said strip has at least 2 layers and said microspheres are entrapped between layers.

* * * * *